US005090053A

United States Patent [19]

Hayes

[11] Patent Number: 5,090,053

[45] Date of Patent: Feb. 25, 1992

[54] COMPOSITE SHOCK ABSORBING GARMENT

[75] Inventor: Harry D. Hayes, Chippewa Falls, Wis.

[73] Assignee: Dalton Enterprises, Chippewa Falls, Wis.

[21] Appl. No.: 637,166

[22] Filed: Jan. 3, 1991

[51] Int. Cl.[5] ..... A41D 13/00; F41H 1/02

[52] U.S. Cl. ..... 2/2; 2/2.5; 2/84; 2/267; 2/243 A; 428/397

[58] Field of Search ..... 2/2, 2.5, 4, 16, 24, 2/81, 84, 102, 267, 268, 243 A; 428/255, 394, 397, 911

[56] References Cited

U.S. PATENT DOCUMENTS

| | | | |
|---|---|---|---|
| 2,825,168 | 3/1958 | Ekman | 428/255 X |
| 2,851,389 | 9/1958 | Lappala | 428/255 X |
| 3,646,749 | 3/1972 | Clough et al. | 428/394 X |
| 4,070,519 | 1/1978 | Lefkowitz et al. | 428/255 X |
| 4,265,972 | 5/1981 | Rudner | 428/394 X |
| 4,303,733 | 12/1981 | Bulle et al. | 428/394 X |
| 4,361,623 | 11/1982 | Newkirk et al. | 428/394 |
| 4,453,271 | 6/1984 | Donzis | 2/2 |
| 4,483,020 | 11/1984 | Dunn | 2/2.5 |
| 4,533,594 | 8/1985 | Buchanan | 428/255 X |
| 4,608,717 | 9/1986 | Dunbavand | 2/2.5 |
| 4,645,297 | 2/1987 | Voshihara et al. | 428/394 X |
| 4,697,285 | 10/1987 | Sylvester | 2/2.5 |
| 4,713,291 | 12/1987 | Sasaki et al. | 428/394 X |
| 4,716,594 | 1/1988 | Shannon | 2/4 |
| 4,748,064 | 5/1988 | Harpell et al. | 428/113 |
| 4,783,853 | 11/1988 | Zuber | 2/2 |

FOREIGN PATENT DOCUMENTS

| | | | |
|---|---|---|---|
| 0229307 | 11/1985 | German Democratic Rep. | 2/102 |
| 0267858 | 5/1976 | U.S.S.R. | 2/4 |
| 0884668 | 11/1981 | U.S.S.R. | 2/4 |

*Primary Examiner*—Werner H. Schroeder
*Assistant Examiner*—Jeanette E. Chapman
*Attorney, Agent, or Firm*—Merchant, Gould, Smith, Edell, Welter & Schmidt

[57] ABSTRACT

A composite shock absorbing material for use in ballistic projectile protective garments, vibration reducing machine mountings, impact absorbing bumpers, exercise mats, protective sporting equipment, and the like, includes an array of elongated strands forming a mesh. Each strand includes an inner force transmitting core surrounded by a visco-elastic polymer. The inner core may be formed by a fiber or a fluid material. In the case of fiber cores, the fibers are intertwined to distribute impact forces throughout the mesh. In the case of fluid cores, the fluid passages are interconnected at each strand intersection, to distribute force throughout the mesh, and to provide a coolant flow path for a circulating fluid cooling system designed for use by wearer's of ballistic penetration protective garments. The visco-elastic polymer may be coated by a penetration resistant material, such as nylon or an aramid fabric. The mesh may be covered by an attached or separate layer of an aramid fabric, and may be used in attached or separate multi-ply arrangements, depending upon the requirements of particular applications.

16 Claims, 8 Drawing Sheets

COMPOSITE SHOCK ABSORBING GARMENT

BACKGROUND OF THE INVENTION

1. Field of the Invention

The present invention relates to composite shock absorbing materials, and more particularly pertains to an improved material which is adapted for use in protective garments such as bullet proof vests. The composite shock absorbing material of the present invention may also have applications in the fields of vibration reducing machine mountings, impact absorbing bumpers, exercise mats, protective sporting equipment, and the like.

2. Description of the Prior Art

Protective garments such as bullet proof vests, flak jackets and body suits are known in the art, and are currently employed by police and military personnel operating in combat zones and other hazardous environments. A large amount of research has been done in this field, and has resulted in the development of materials capable of withstanding relatively high energy ballistic impacts, without being penetrated. The most effective conventional protective garments employ an aramid material, of the type sold under the trademark KEVLAR.

Although such garments are sometimes effective, they are often undesirably heavy, bulky, and uncomfortably hot to wear. Because of these undesirable characteristics, individuals may be reluctant to wear such garments, even in hazardous environments. As a result, individuals in such dangerous environments are unprotected for a significant portion of the time.

Additionally, while the prior art protective garments do afford significant protection against penetrating injury upon impact of a ballistic projectile, very large shock forces are nonetheless transmitted to the wearer. These shock forces are distributed over a very small surface area of the wearer's body, and often result in severe blunt trauma injuries.

SUMMARY OF THE INVENTION

Accordingly, it is an object of the present invention to provide a protective garment, formed from a new and improved composite shock absorbing material, which is light in weight.

It is a further object of the present invention to provide a protective garment, formed from a new and improved composite shock absorbing material, which is cool and comfortable to wear.

An additional object of the present invention is to provide a protective garment formed from a new and improved composite shock absorbing material for better impact force distribution and coolant circulation.

An even further object of the present invention is to provide a protective garment, formed from a new and improved composite shock absorbing material, which provides a high degree of protection against penetrating and blunt trauma injuries from ballistic projectiles.

Even still another object of the present invention is to provide a new and improved multi-layer protective garment system, having a plurality of separable component layers which may be selectively worn according to varying situational and environmental factors.

Still another object of the present invention is to provide a new and improved composite shock absorbing material having a high resistance to penetration and capable of a high degree of impact force distribution.

Yet another object of the present invention is to provide a new and improved composite shock absorbing material suitable for use in vibration reducing machine mountings, impact absorbing bumpers, exercise mats, protective sporting equipment, and the like.

In order to achieve these and other objects of the invention, the present invention provides an improved composite shock absorbing material for use in ballistic projectile protective garments, vibration reducing machine mountings, impact absorbing bumpers, exercise mats, protective sporting equipment, and the like, which includes an array of elongated strands forming a mesh. Each strand includes an inner force transmitting core surrounded by a visco-elastic polymer. The inner core may be formed by a fiber or a fluid material. In the case of fiber cores, the fibers are intertwined to distribute impact forces throughout the mesh. In the case of fluid cores, the fluid passages are interconnected at each strand intersection, to distribute force throughout the mesh, and to provide a coolant flow path for a circulating fluid cooling system designed for use by wearer's of ballistic penetration protective garments. The visco-elastic polymer may be coated by a penetration resistant material, such as nylon or an aramid fabric. The mesh may be covered by an attached or separate layer of an aramid fabric, and may be used in attached or separate multi-ply arrangements, depending upon the requirements of particular applications.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENT(S)

Figure 1:
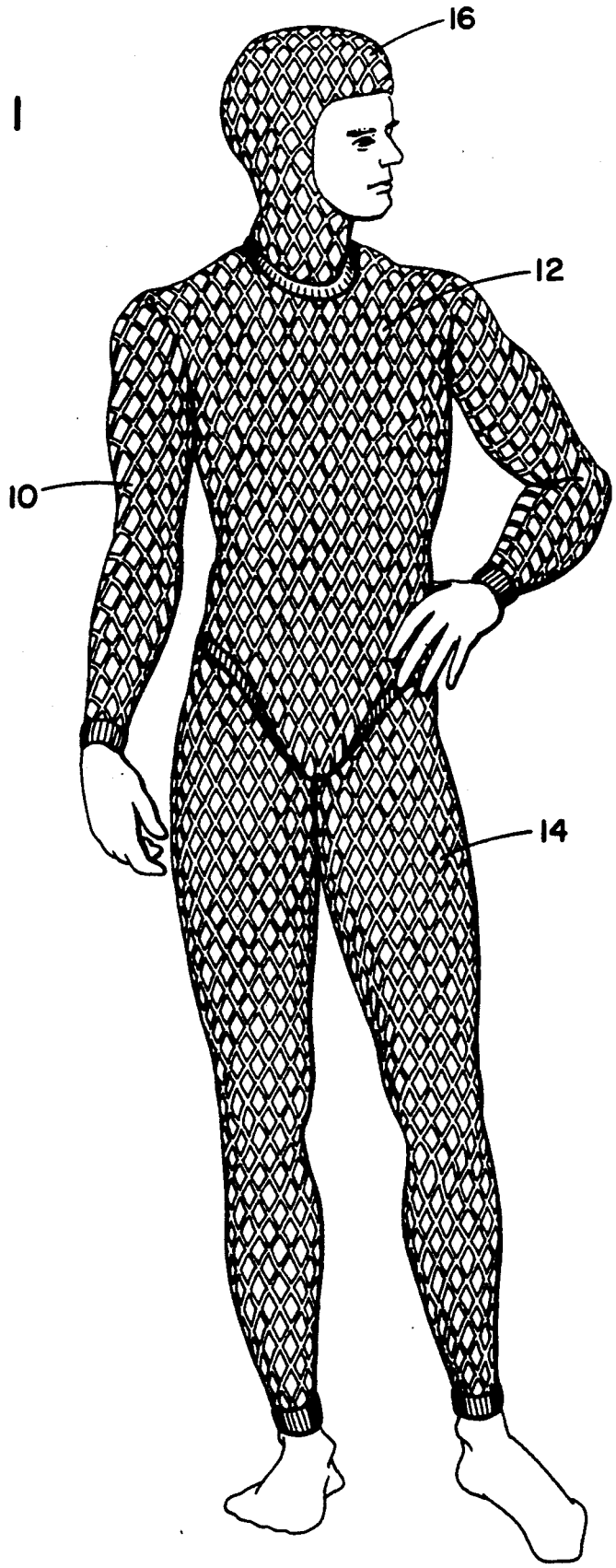
FIG. 1 is a perspective view of a person wearing protective mesh garments formed from shock absorbing composite material according to the present invention.

Referring now to the drawings, wherein like reference numerals designate corresponding structure throughout the views, and referring in particular to FIG. 1, an improved composite shock absorbing material 10 according to a first preferred embodiment of the invention includes a plurality of elongated strands which are interconnected in an array to form an open mesh material. The material 10 may be employed in the manufacture of protective garments such as a shirt 12, trousers 14, and a hood 16. It should be understood that these particular forms of protective apparel are for illustrative purposes only, and that the material 10 may be utilized in the formation of a variety of other forms for the protection of various body parts of an individual. For example, vests, knee pads, shoulder pads, thigh pads and similar articles may be constructed utilizing the shock absorbing materials of the present invention. In any event, the open mesh configuration of the material 10 provides a substantial weight reduction over conventional solid sheet materials, and allows air circulation to the body of the individual.

Figure 2:
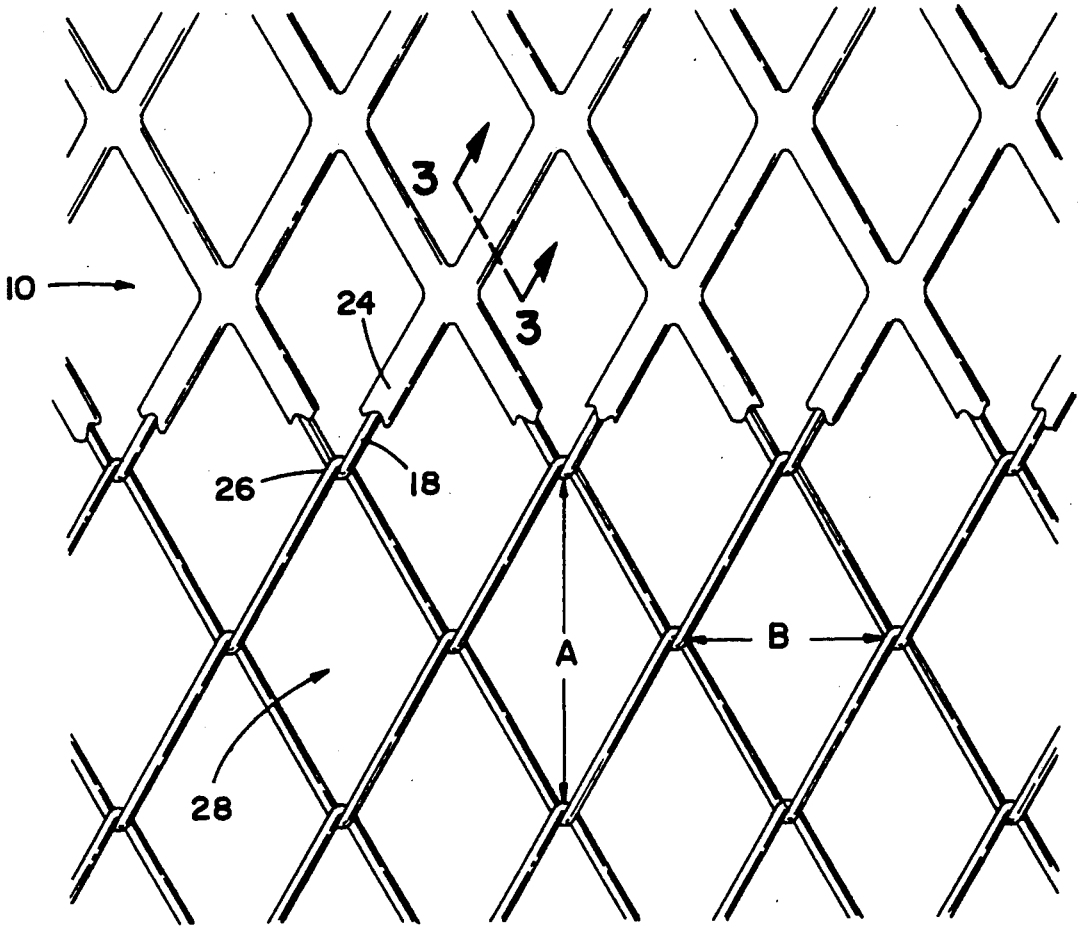
FIG. 2 is a fragmentary plan detail view, partially cut away, illustrating a composite shock absorbing material according to a first embodiment of the invention.

FIG. 2 illustrates the construction of a material 10 according to a first embodiment of the invention. An elongated fiber 18 forms the core of each of the elongated intersecting strands. The fibers 18 are intertwined at each intersection 26 in the manner illustrated. Each of the strands includes an outer protective coating 24, which is preferably formed from a nylon or high strength aramid fiber material such as the type sold under the trademark KEVLAR. This affords protection against penetration to the fiber 18, and also to the body of an individual. A mesh array having a parallelogram diamond shaped opening 28 pattern is preferred, with a longer diagonal dimension A of $1\frac{3}{4}$ inches and a shorter diagonal dimension B of 1 inch. Alternatively, the mesh may be formed in a variety of other patterns, for example square, rectangular and octagonal shaped mesh openings may be employed within the scope of the invention.

Figure 3:
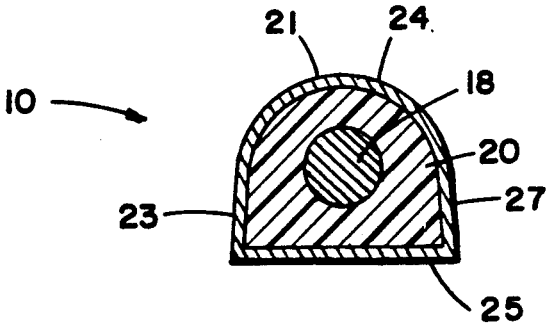
FIG. 3 is a transverse cross-sectional view taken along line 3—3 of FIG. 2.

FIG. 3 is a transverse cross-sectional view which illustrates the internal construction of each of the elongated strands forming the composite material 10. The inner core 18 is a high strength fiber, preferably from the group of materials including nylons, silk, aramid fiber and synthetic spider silk. Preferably, aramid fibers are used. Core 18 preferably has a diameter of 1/16 inch. The fiber core 18 is surrounded by a visco-elastic polymer 20. The polymer 20 is preferably of the type sold under the trademark SORBOTHANE, by Sorbothane, Inc. of Kent, Ohio, but other known visco-elastic polymers can also be used.

The polymer 20 is surrounded by a coating 24, which is preferably formed from a high strength fabric material such as nylon or KEVLAR TM. The thickness dimension of the polymer layer 20, between the outer surface of the polymer 20 and the outer surface of the fiber 18, is preferably about 1/16 of an inch. The outer coating 24 preferably has a thickness of about 3 mils inches. The transverse cross-sectional shape of each strand includes a radiused top surface 21 which terminates at opposite sides in straight downwardly diverging inclined side walls 23 and 27. Bottom ends of the side walls 23 and 27 are connected by a planar bottom surface 25, adapted to be positioned facing the body of a wearer of a protective garment formed from the material 10. The strands may be formed of other transverse cross-sectional shapes such as square, rectangular, or circular, within the scope of the present invention.

Figure 4:
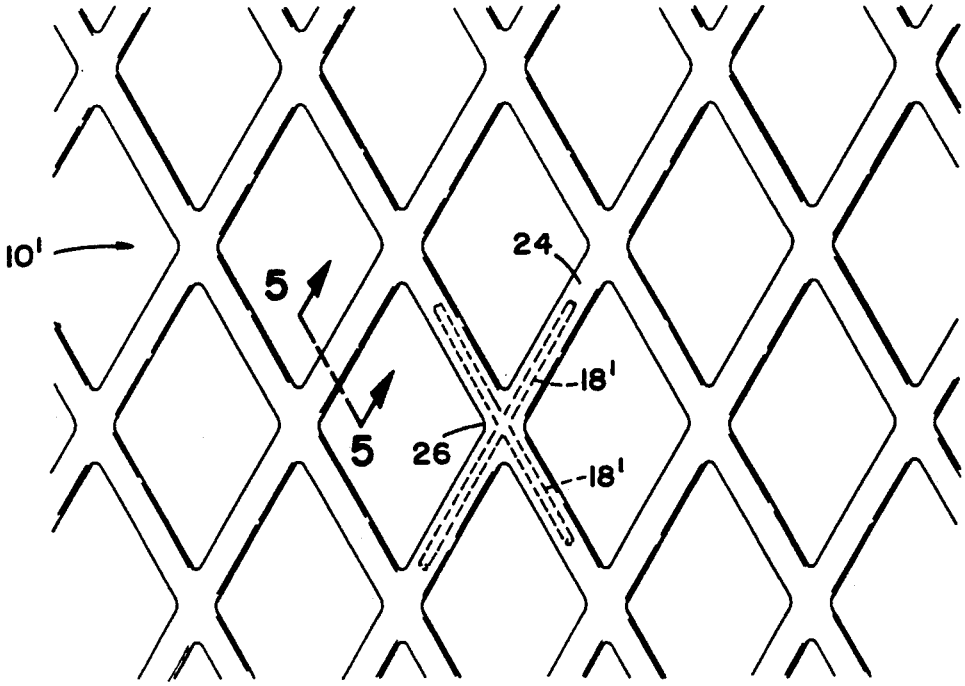
FIG. 4 is a fragmentary plan detail view, illustrating a composite shock absorbing material according to a second embodiment of the invention.

FIG. 4 illustrates an alternative composite shock absorbing material 10', in which each of the intersecting elongated strands are provided with a fluid core 18'. At each intersection 26, the interior fluid cores 18' intersect in fluid communication. This construction allows the fluid to transmit impact forces throughout the mesh array in accordance with the principles of hydraulics. Additionally, this construction affords fluid flow passages for use in a circulating fluid cooling system.

Figure 5:
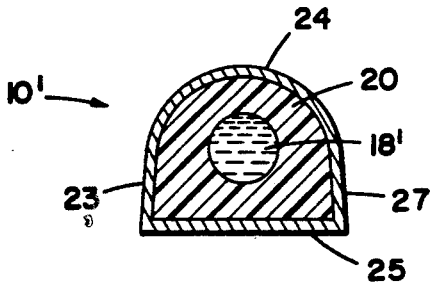
FIG. 5 is a transverse cross-sectional view, taken along line 5—5 of FIG. 4.

FIG. 5 is a transverse cross-sectional view which illustrates the internal construction of each of the elongated strands forming the composite shock absorbing material 10'. The inner core 18' is preferably filled with a liquid, although a gas may also be employed within the scope of the present invention. The preferred fluid is polydimetysil oxane, which is commonly called fluid silicon. It is commercially available from Dow Corning in their "200 Series" of chemicals. Ethylene glycol could also be used. Additionally, the fluid core 18' may include a fluid sealant compound to provide a self-sealing construction in the event of perforation of the polymer layer 20. An aerobic sealant may be employed, such that the sealant hardens upon contact with air in the event of a rupture. A suitable sealant material is Flurosiliane 730, which is also available from Dow Corning. While the fluid core 18' is illustrated with a circular cross-sectional shape, other cross-sectional shapes such as square, rectangular, etc. may be employed within the scope of the invention. The core 18' preferably has a diameter of 1/16 of an inch. The polymer layer 20 preferably has a thickness dimension from an outer surface of the polymer layer 20 to the outer portion of the fluid core 18' of 1/16 of an inch. The coating 24 has a preferred thickness of about 3 mils. The coating 24 and the polymer 20 are preferably formed from the same materials described previously with respect to the embodiment shown in FIG. 3.

Figure 6:
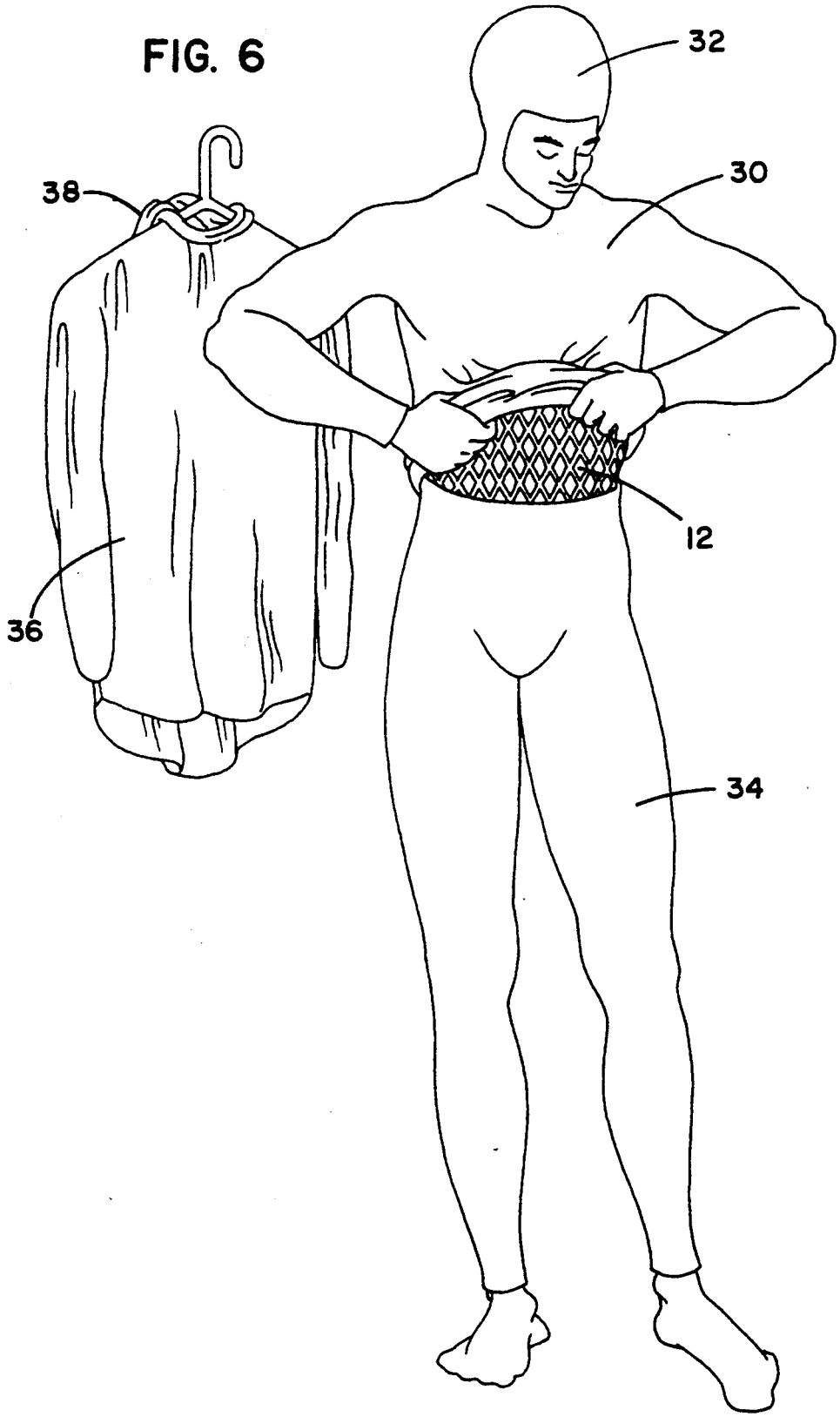
FIG. 6 is a perspective view of a person putting on separate component layers of a multi-layer protective garment system according to the present invention.

FIG. 6 illustrates a ballistic protective garment system, employing the composite shock absorbing material according to the present invention. The individual first puts on an underlayer of protective garments formed from the mesh protective material, as illustrated in FIG. 1. The individual subsequently puts on a second layer of protective garments, which may include a shirt 30, a hood 32 and trousers 34. The protective garments 30, 32 and 34 are preferably formed from a conventional penetration resistant material, for example KEVLAR TM. The garments 30, 32 and 34 may also be formed from multiple KEVLAR TM layers or a combination of desired proportions of KEVLAR TM, nylon, a material which is commercially available under the Trademark SPECTRASHIELD from Allied Fiber Co. of Morristown, N.J. Synthetic spider silk may also be included in the material which is used to make garments 30, 32, 34. The garments 30, 32 and 34 provide resistance to penetration by ballistic projectiles. In the event of an impact by a high velocity projectile, impact force is transmitted through the outer garments 30, 32 or 34 to the underlying composite shock absorbing material, for example the shirt 12. The impact force is dissipated throughout the mesh array, preventing blunt trauma injury to the individual. An additional outer protective garment may include a jacket 36 having a hood 38. The outer garment may alternatively be a conventional bullet proof vest. The outer protective garment may be formed in any conventional manner, and may include KEVLAR TM and/or nylon materials. This protective garment system allows an individual to put on or take off the various layers of garments, depending upon the degree of danger and other environmental factors. While a protective garment system having three separate layers has been illustrated and described, it should be understood that an additional number of layers may be employed without departing from the scope of the present invention.

Figure 7:
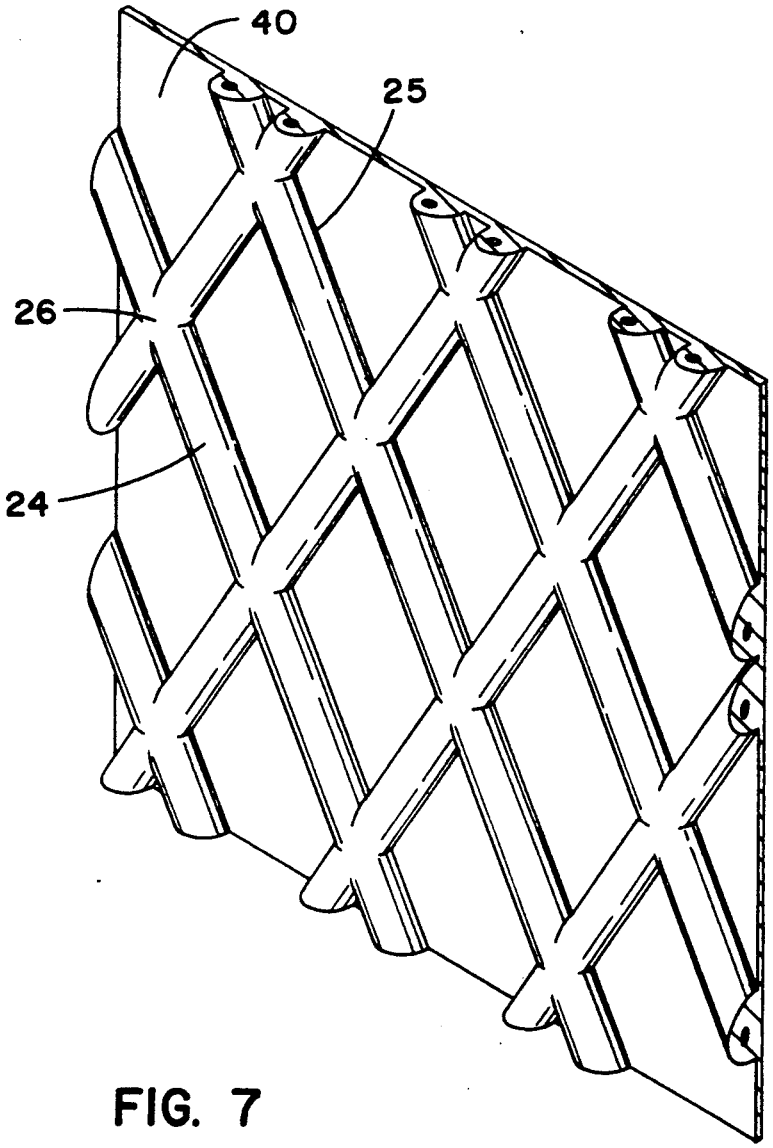
FIG. 7 is a fragmentary perspective view of an integral multi-layer composite shock absorbing material according to the present invention.

FIG. 7 illustrates an additional alternative construction, in which a penetrative resistant layer 40 is attached directly to the mesh shock absorbing material. It should be understood that this construction may be employed utilizing either the fiber core construction of FIG. 3 or the fluid core construction of FIG. 5. The penetration resistant layer 40 is preferably a KEVLAR TM fabric which is bonded directly to the flat bottom surface 25 of each of the strands forming the mesh array. Conventional bonding techniques and materials such as adhesives may be employed. Alternatively, the layer 40 may be secured to the mesh array through the use of mechanical fasteners.

Figure 8:
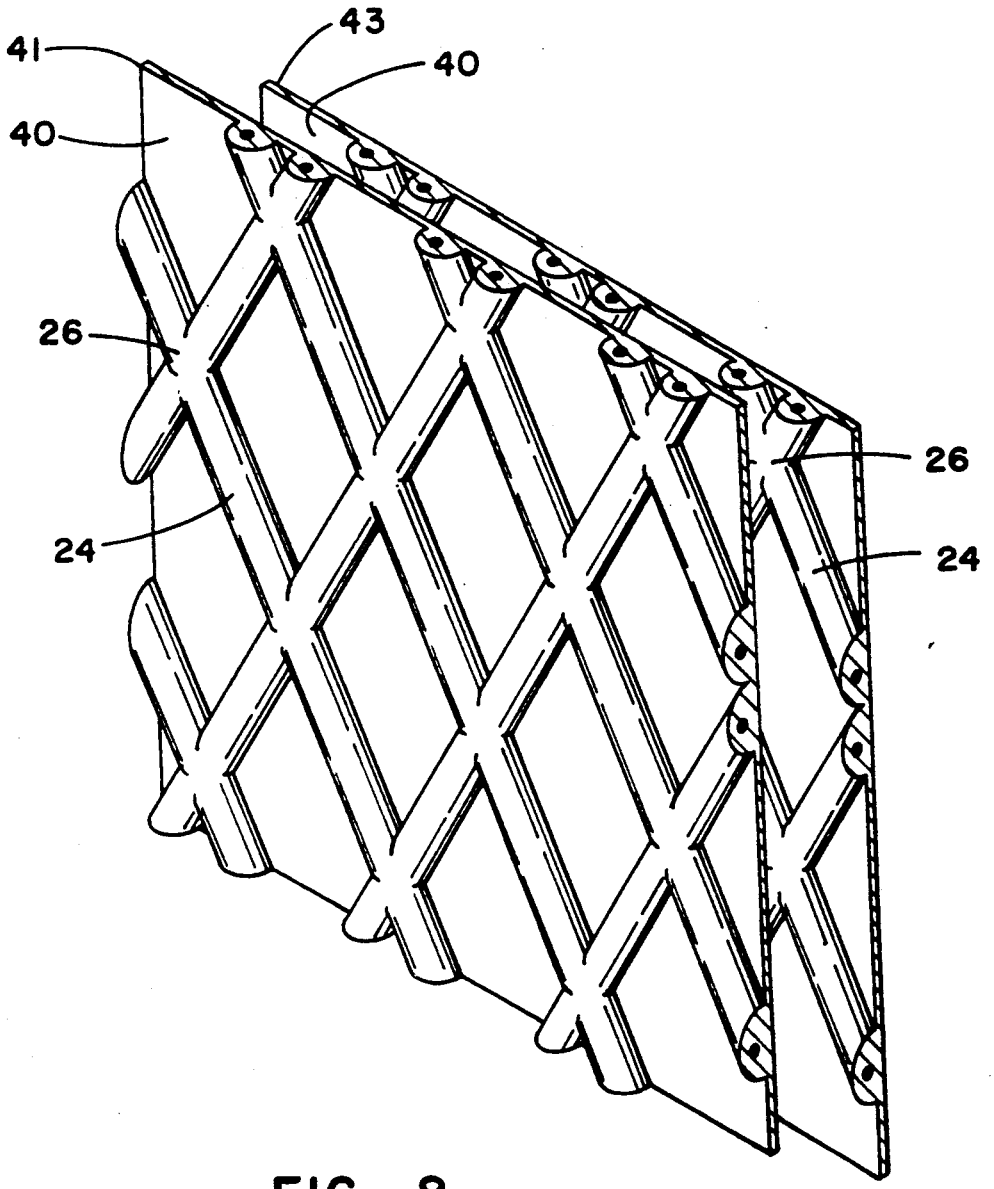
FIG. 8 is a fragmentary perspective view of a composite shock absorbing material utilizing multiple plies of the material illustrated in FIG. 7.

FIG. 8 illustrates a multi-ply construction, in which a first 41 layer and a second 43 layer are secured in overlying staggered relation such that the intersections 26 of the respective mesh arrays are disposed in offset relation. The layers 41 and 43 may be secured by bonding techniques such as adhesives, or through the use of mechanical fasteners. Alternatively, the layers 41 and 43 may comprise separate inner and outer protective garments, which are not directly secured.

Figure 9:
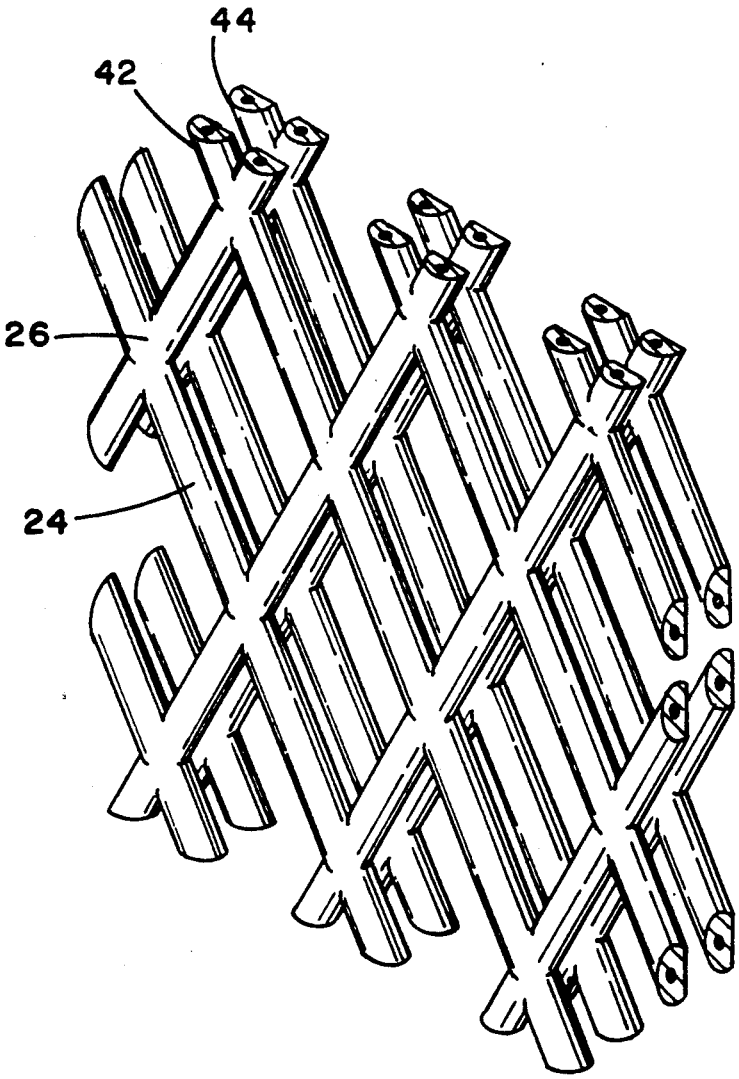
FIG. 9 is a fragmentary perspective view of a composite shock absorbing material utilizing multiple plies of the material illustrated in FIG. 4.

FIG. 9 illustrates a similar arrangement, in which the open mesh composite shock absorbing material is employed in a multi-ply arrangement. A first layer 42 and a second layer 44 are disposed in an offset staggered overlying arrangement. The layers 42 and 44 may be secured by bonding, mechanical fasteners, or may comprise inner and outer overlying protective garments. In either case, the fiber core construction of FIG. 3 or the fluid core construction of FIG. 5 may be employed.

Figure 10:
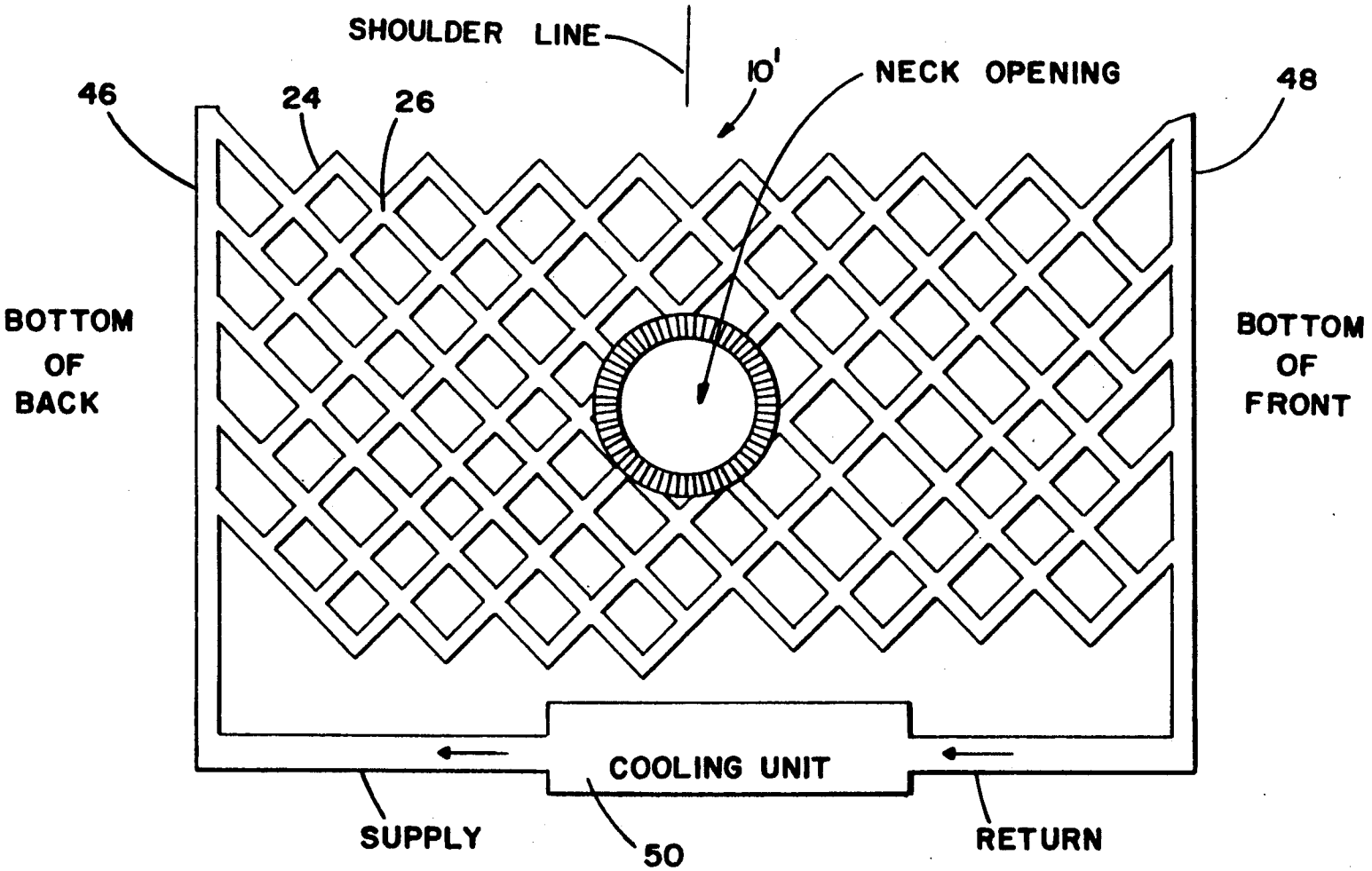
FIG. 10 is a diagrammatic illustration of a circulating fluid cooling system for use in a protective garment formed from the fluid core composite shock absorbing material of the present invention.

FIG. 10 is a diagrammatic view illustrating a cooling system for use in a protective garment formed with the fluid core construction, of the type illustrated in FIG. 5. A protective garment, for example a vest, has a central neck opening surrounded by a collar. FIG. 10 is a diagrammatic projection of such a garment which depicts the bottom of the vest back at the left hand portion of the figure and the bottom of the vest front at the right hand portion of the figure. Supply 46 and return 48 distribution manifolds are connected in fluid communication with the liquid filled cores of the intersecting strands forming the material 10'. A cooling unit 50 is operative to circulate the liquid in a closed loop throughout the garment, from the bottom of the vest back, over the shoulder line, to the bottom of the vest front and subsequently back to the cooling unit 50, and through an internal heat exchanger. The cooling unit 50 may take a variety of conventional forms, including a compressor-refrigerant system, an evaporative cooling system, or may utilize re-freezable gel refrigerant packs. The cooling unit 50 is preferably of a relatively small size, to permit wearing as a backpack, or within a belt pouch on the body of an individual. Conventional rechargeable battery packs may be employed within the cooling unit 50, to provide a power source to a compressor, or a circulating pump.

While the various disclosed alternative composite shock absorbing materials have been described principally with respect to application in ballistic protective garments, it should be understood that these materials may be employed in vibration reducing machine mounting pads, impact absorbing bumpers, protective sporting equipment, and the like, without departing from the scope and content of the present invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A composite shock absorbing material for use in protective garments, comprising:

an open mesh array formed by a plurality of intersecting interconnected strands;

wherein each of said strands has a core surrounded by a visco-elastic polymer material, the cores of said strands being formed by a liquid material.

2. The composite shock absorbing material of claim 1, wherein said liquid material includes a sealant material.

3. A composite shock absorbing material for use in protective garments, comprising:

an open mesh array formed by a plurality of intersecting interconnected strands;

wherein each of said strands has a core surrounded by a visco-elastic polymer material, said cores of said strands being formed by a liquid material liquid comprising a fluid selected from the group of polydimetyl siloxane and ethylene glycol.

4. A composite shock absorbing material for use in protective garments, comprising:

an open mesh array formed by a plurality of intersecting interconnected strands;

wherein each of said strands has a core surrounded by a visco-elastic polymer material, said cores of said strands being formed by a liquid material and said cores being connected in fluid communication at the intersections of said strands.

5. A composite shock absorbing material for use in protective garments, comprising:

an open mesh array formed by a plurality of intersecting interconnected strands;

wherein each of said strands has a core surrounded by a visco-elastic polymer material, said visco-elastic polymer material comprising SORBOTHANE.

6. A composite shock absorbing material for use in protective garments, comprising:

an open mesh array formed by a plurality of intersecting interconnected strands;

wherein each of said strands has a core surrounded by a visco-elastic polymer material, and a penetration resistant coating surrounding said visco-elastic polymer material.

7. A composite shock absorbing material for use in protective garments, comprising:

an open mesh array formed by a plurality of intersecting interconnected strands and a plurality of plies of said mesh secured in overlying relation;

wherein each of said strands has a core surrounded by a visco-elastic polymer material.

8. A composite shock absorbing material for use in protective garments, comprising:

an open mesh array formed by a plurality of intersecting interconnected strands;

wherein each of said strands has a core surrounded by a visco-elastic polymer material, and a penetration resistant layer secured in overlying parallel relation to said mesh.

9. The composite shock absorbing material of claim 8, further comprising a plurality of plies of said mesh and attached penetration resistant layers secured in overlying relation.

10. A composite shock absorbing material for use in protective garments, comprising:

an open mesh array formed by a plurality of intersecting interconnected strands;

wherein each of said strands has a core surrounded by a visco-elastic polymer material, each of said strands being a radiused upper surface connecting spaced downwardly diverging sidewalls and a planar bottom surface extending between said sidewalls.

11. A composite shock absorbing material for use in protective garments, comprising:

an open mesh array formed by a plurality of intersecting interconnected strands, openings in said open mesh array being in the shape of a parallelogram;

wherein each of said strands has a core surrounded by a visco-elastic polymer material.

12. A protective garment, comprising:

an open mesh array formed by a plurality of intersecting interconnected strands; and each of said strands having a core surrounded by a visco-elastic polymer material, the cores of said strands being formed by a fluid material and the cores being connected in fluid communication at the intersections of said strands.

13. The protective garment of claim 12, further comprising means for cooling and circulating said fluid material within said cores throughout said mesh.

14. A protective garment, comprising:

an open mesh array formed by a plurality of intersecting interconnected strands and a plurality of plies of said mesh secured in overlying relation; and each of said strands having a core surrounded by a visco-elastic polymer material.

15. A protective garment, comprising:

an open mesh array formed by a plurality of intersecting interconnected strands and a penetration resistant layer secured in overlying parallel relation to said mesh; and each of said strands having a core surrounded by a visco-elastic polymer material.

16. The protective garment of claim 15, further comprising a plurality of plies of said mesh and attached penetration resistant layers secured in overlying relation.

* * * * *